United States Patent [19]

Kunz

[11] 4,032,747

[45] June 28, 1977

[54] THERMAL HAIR STYLING APPLIANCE HAVING INTERCHANGEABLE ATTACHMENTS

[75] Inventor: Raymond W. Kunz, Monroe, Conn.

[73] Assignee: Clairol Incorporated, New York, N.Y.

[22] Filed: Nov. 12, 1975

[21] Appl. No.: 631,323

[52] U.S. Cl. ..... 219/222; 132/37 R; 132/118; 132/120; 219/225; 219/241; 219/511; 279/24; 403/326; 403/354

[51] Int. Cl.[2] ..... H05B 1/02; A45D 1/04; A45D 2/36; B25G 3/18

[58] Field of Search ..... 219/222–226, 219/230, 241, 533, 511; 403/354, 326, 329, 330, 328; 279/104, 105, 24, 79; 132/9, 1.2, 116–118, 120–124, 148, 150, 31, 32, 34, 37; 30/335, 337

[56] References Cited

UNITED STATES PATENTS

| | | | |
|---|---|---|---|
| 204,812 | 6/1878 | Gladding | 279/24 X |
| 267,060 | 11/1882 | Buell | 403/328 X |
| 366,432 | 7/1887 | Schwab | 30/337 X |
| 899,038 | 9/1908 | Furman | 132/122 X |
| 1,010,913 | 12/1911 | Hope | 132/120 |
| 1,033,122 | 7/1912 | Schwartz | 132/118 |
| 1,376,416 | 5/1921 | Forshee | 132/118 |
| 1,689,809 | 10/1928 | Vaughan | 219/511 |
| 1,794,574 | 3/1931 | Bertelsen et al. | 132/37 R |
| 2,360,084 | 10/1944 | Taylor | 219/511 |
| 3,835,292 | 9/1974 | Walter et al. | 219/225 X |
| 3,973,528 | 8/1976 | Walter et al. | 132/37 R |

*Primary Examiner*—A. Bartis
*Attorney, Agent, or Firm*—Sherman & Shalloway

[57] ABSTRACT

A thermal hair styling appliance includes interchangeable attachments, such as hair retaining clips, combbrush clips or other types of attachments which are selectively attached to an operating button that is pivoted on a handle of the appliance. The appliance further includes a main electric heater which is controlled by a thermostat which, in turn, responds to a pair of auxiliary heaters. By selectively energizing the auxiliary heaters, the temperature of the main heater is controlled. A versatile hair styling appliance is thus provided. According to one embodiment, the operating button includes at least one projection which engages a slot in the end of the attachment being used. The attachment is held within the button by detents which engage other slots in the end of the attachment.

11 Claims, 9 Drawing Figures

THERMAL HAIR STYLING APPLIANCE HAVING INTERCHANGEABLE ATTACHMENTS

BACKGROUND OF THE INVENTION

1. Field of the Invention

This invention relates to thermal hair styling appliances, and more particularly this invention relates to thermal hair styling appliances which are versatile in that various attachments may be utilized and various heat and vapor conditions may be created.

2. Technical Considerations and Prior Art

Hair styling is an art which frequently requires various implements and environmental conditions to produce desired results. The implements assume many configurations, such as combs, brushes, cylindrical curlers, curlers with clamps, etc. Frequently, in order to increase the effectiveness of such implements, it is necessary to utilize the implements in combination with heat and/or vapor. When using heat and/or vapor, it is often desirable to have the option of varying readily both the quantity of heat and the quantity of vapor applied. The prior art does not provide an appliance having the versatility and flexibility to meet all of these requirements.

Currently on the market, there are numerous steam curling irons which have had considerable commercial success. Exemplary of these steam curling irons, is the steam curling iron disclosed in U.S. Pat. No. 3,835,292 which is assigned to the assignee of the instant invention. Although the steam curling iron disclosed in this patent performs successfully, it does not include structure for providing a range of temperatures or structure for varying the configuration of its hair styling implement. Essentially, the appliance disclosed in U.S. Pat. No. 3,835,292 provides a single implement which only allows for selective vapor application.

There are steam curling irons available, which have variable temperature control. However, the controls used with these steam curling irons have various deficiencies. One steam curling iron utilizes a low-wattage section which is not thermostatically controlled and a high-wattage section which is thermostatically controlled. With this device there is no positive cut-off for the low-wattage section, and it has been found that the stabilization temperature in the low and high-wattage sections are ultimately the same. This is because as the power is applied through the low-wattage section, the iron heats up at a relatively slow rate, but since there is no means to terminate application of power, the iron continues to heat until ultimately controlled by the thermostat on the high-wattage section. With this type of temperature control, it is extremely difficult to achieve a precise lower temperature limit.

The prior art includes another approach, in which a thermostat is utilized which includes a fixed contact and a movable contact. A temperature control knob is linked to the movable contact and mechanically changes the distance between the movable contact and the fixed contact, in order to vary the temperature at which contact will be broken. This particular approach requires a relatively sensitive and extensive mechanical linkage, which must extend between the thermostat and the control knob. Accordingly, it is difficult to juxtapose the thermostat with the heater which it monitors. In order to provide for good response and accurate control of the heater, the thermostat should be as close to the heater as possible. With this type of control, close proximity is not possible, because the temperature control knob needs to be spaced from the heater to keep the user from being burned.

A third approach, for controlling the temperature of steam curling irons, uses no thermostat at all, but rather disposes a diode between a rope heater and a power line. For low heat, the diode is switched into the circuit to reduce the power factor of the current, while for high heat the diode is switched out of the circuit, so that the heater receives all of the power. This approach is undesirable in that for temperature stabilization, the steam curling iron relies on ambient heat losses, instead of on the positive control of a thermostat. In addition, only low-wattages can be used, which lengthens the heat-up time considerably.

OBJECTS OF THE INVENTION

In view of the afore-described and other limitations, it is an object of the instant invention to provide a versatile thermal hair styling appliance.

It is another object of the instant invention to provide a new and improved hair styling appliance, wherein various hair treating implements may be used with a single heat and/or vapor generating unit.

It is another object of the instant invention to provide a new and improved hair styling appliance, which increases the versatility and flexibility of the steam curling iron, disclosed in U.S. Pat. No. 3,835,292.

It is still an additional object of the instant invention to provide a new and improved hair styling appliance, wherein a hair retaining clip may be selectively removed and replaced with a combing and brushing attachment.

It is an additional object of the instant invention to provide a new and improved versatile thermal hair styling appliance, wherein the temperature of the appliance can be accurately and reliably controlled.

It is still another object of the instant invention to provide a new and improved hair styling appliance, wherein both the vapor emitted by the appliance and the heat generated by the appliance may be accurately and reliably controlled while attachments provide the appliance with various configurations.

It is still another object of the instant invention to provide a new and improved hair styling appliance having coupling means for selectively and detachably connecting various types of attachments.

SUMMARY OF THE INVENTION

With these and other objects in mind, the instant invention is drawn to a versatile new and improved hair treating device which is provided with means for selectively and detachably connecting various types of attachments which are useful in styling or otherwise treating the hair. The invention is also drawn to a hair treating device having reliable and accurate control of heat generated. The device of the present invention includes a tubular barrel having a heating chamber therein, and heating means disposed within the heating chamber. The tubular barrel also includes a hair treating mandrel therearound for conveying heat to the hair. A handle is attached to one end of the heating chamber. Means for selectively moving attachments relative to the tubular barrel is movably mounted adjacent to one end of the barrel. The moving means may be in the form of a button-type structure. The button includes a coupling means for detachably securing hair treating attachments thereto. The attachments may include a clip which couples with the button, and is pivoted by the button into and out of engagement with the mandrel to secure strands of hair between the clip and the mandrel. The attachments may also include a second clip which couples to the button at one end and is secured to the mandrel at the other end, so that it will not pivot with respect to the mandrel. This clip may have rows of spaced projections, such as teeth or bristles.

In addition, the instant invention contemplates a hair treating device which includes a heater in the form of an annular ceramic unit. The heater is controlled by a thermostat disposed in thermal conductive relation thereto. Auxiliary heaters, in the form of electrical resistors, are also in thermal conductive contact with the thermostat and means are provided for selectively energizing the auxiliary heaters to cause the thermostat to respond to the auxiliary heaters, as well as to the main heater.

Other objects and advantages of the instant invention will become apparent from the following description of the preferred embodiments, taken in conjunction with the following drawings.

DETAILED DESCRIPTION

Figure 1:
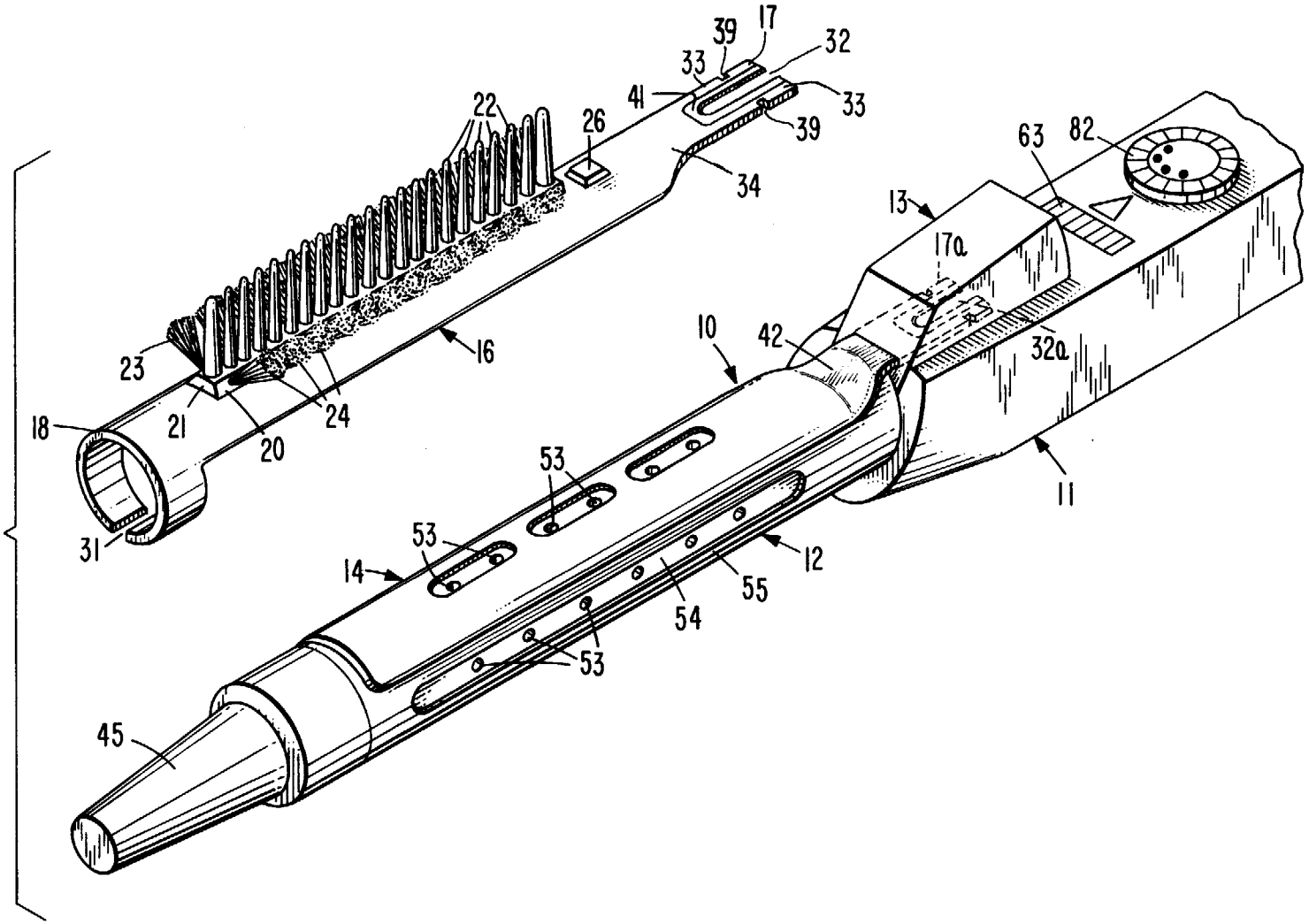
FIG. 1 is a perspective view of a thermal hair styling appliance in accordance with the instant invention, showing a hair retaining clip coupled to the appliance, and a comb-brush clip, which can selectively replace the hair retaining clip.

Referring now to FIG. 1, there is shown a thermal hair styling appliance, generally designated by the numeral 10, which includes many of the features disclosed in the U.S. Pat. No. 3,835,292, incorporated herein by reference. Basically, the thermal hair styling appliance includes a handle, designated generally by the numeral 11, which forms a housing and which has attached thereto, an axially extending tubular barrel, designated generally by the number 12, and a button, designated generally by the numeral 13. The button 13 is mounted on the handle with a sliding pivot in the manner similar to that disclosed in U.S. Pat. No. 3,835,292. A hair clip, designated generally by the numeral 14, is selectively attached or coupled to the button 13, so as to be removed therefrom, if desired. The hair clip may be replaced by another attachment, such as the comb-brush clip, designated generally by the numeral 16.

Figure 2:
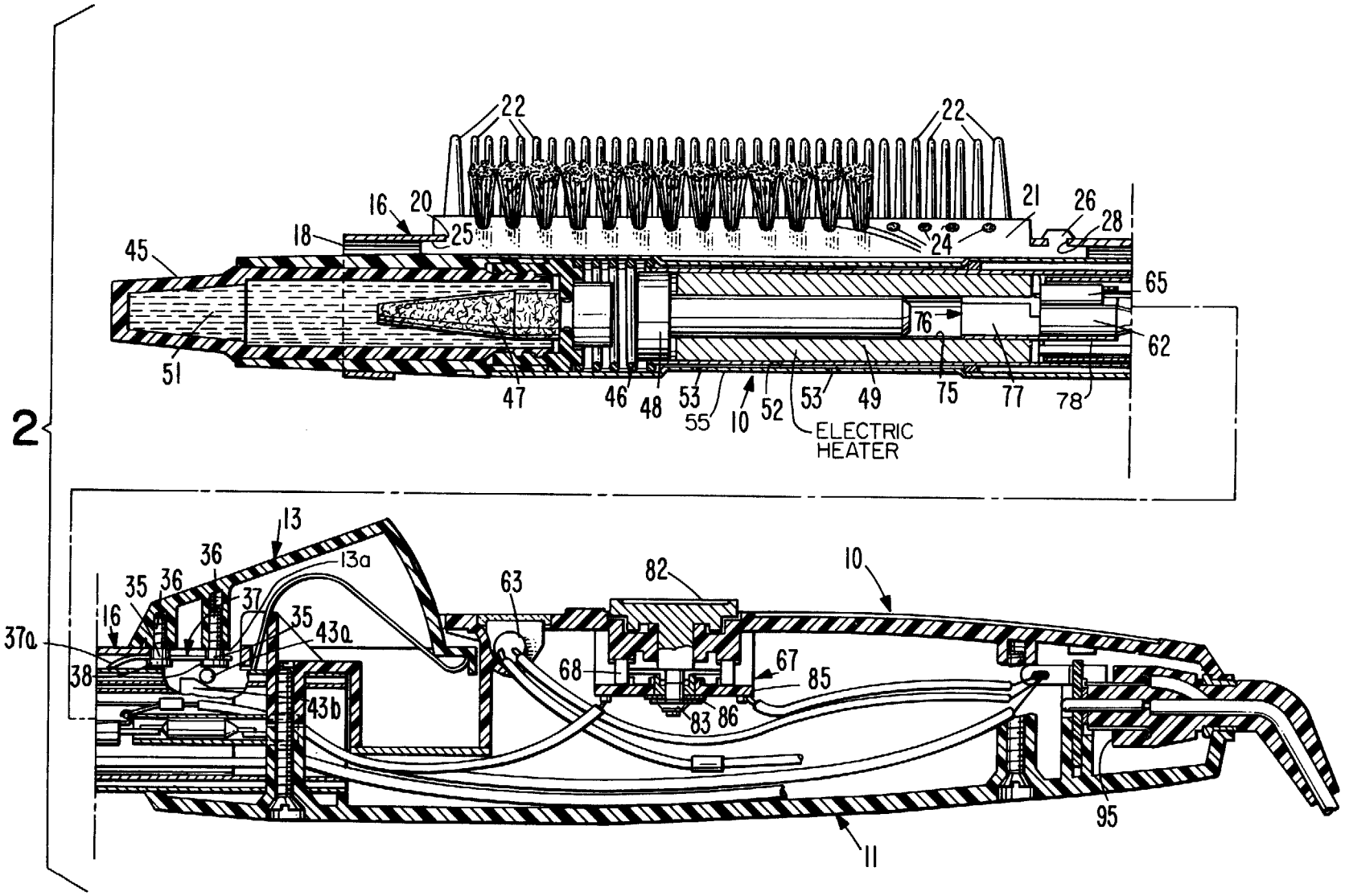
FIG. 2 is a sectional view of the thermal hair styling appliance of FIG. 1, showing the internal configuration of the appliance and showing a comb-brush clip attached thereto.

The comb-brush clip 16 includes a slotted first end portion 17, which registers with the button 13 and an annular second end portion 18, which slides over the tubular barrel 12. As shown in FIG. 2, the comb-brush clip 16 is secured at both ends to the tubular barrel 12 and, consequently, cannot pivot relative to the tubular barrel, as does the clip 14.

Referring now to both FIGS. 1 and 2, the comb-brush clip 16 includes a slot 20, through which projects a plastic base 21, having a row of plastic comb teeth 22, which are preferably integral therewith. The base 21 also has parallel rows of bristle tufts 23 on opposite sides of the teeth 22.

As shown in FIG. 2, base 21 is secured at one end to the clip 16 by a notch 25 in the base, which receives the edge of the slot 20. The other end of the base 21 is secured to the clip 16 by a lug 26, which is registered with a hole 28 in the clip and heat-spiked over the hole.

The clip 16 is dimensioned so that when it is slid over the tubular barrel 12, the annular end portion 18 with which the barrel registers, will hold the base 21 in engagement with the tubular barrel. Preferably, the annular end portion 18 will have a slit 31 (FIG. 1) extending therethrough, so that it can expand slightly and grip frictionally the tubular barrel 12.

Figure 4:
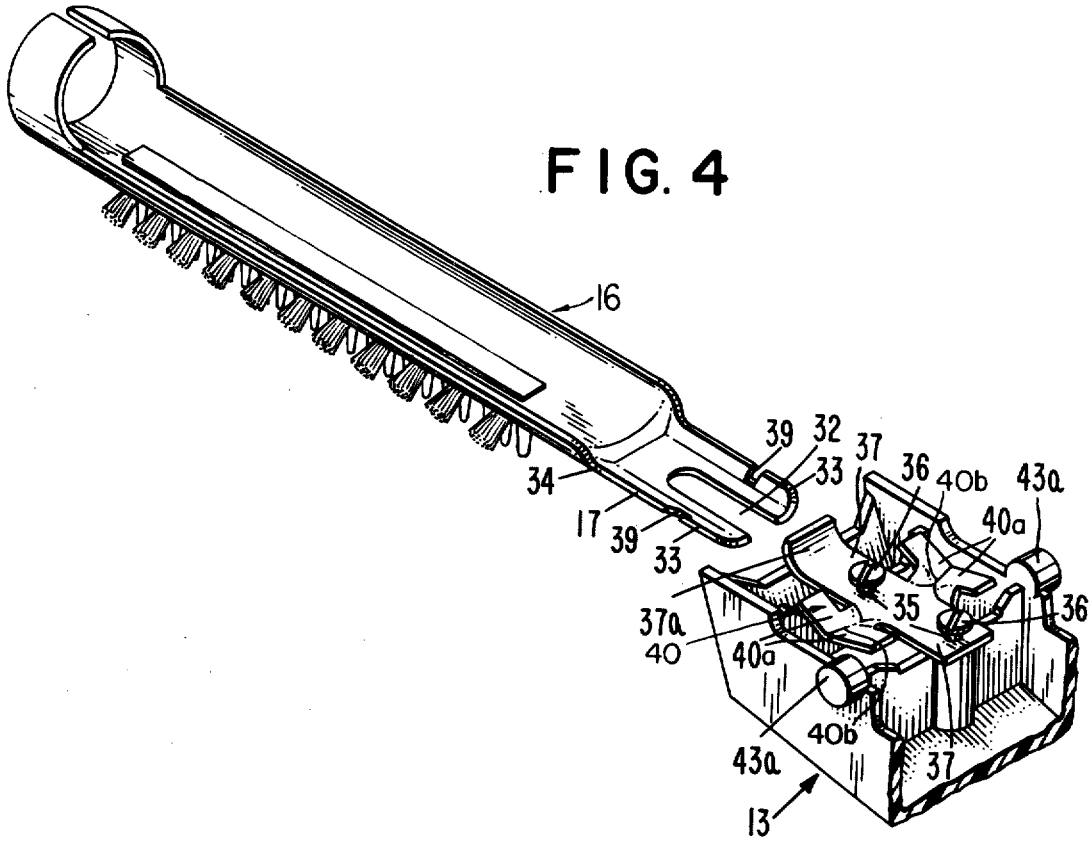
FIG. 4 is an exploded perspective view of the coupling of FIG. 3.
Figure 3:
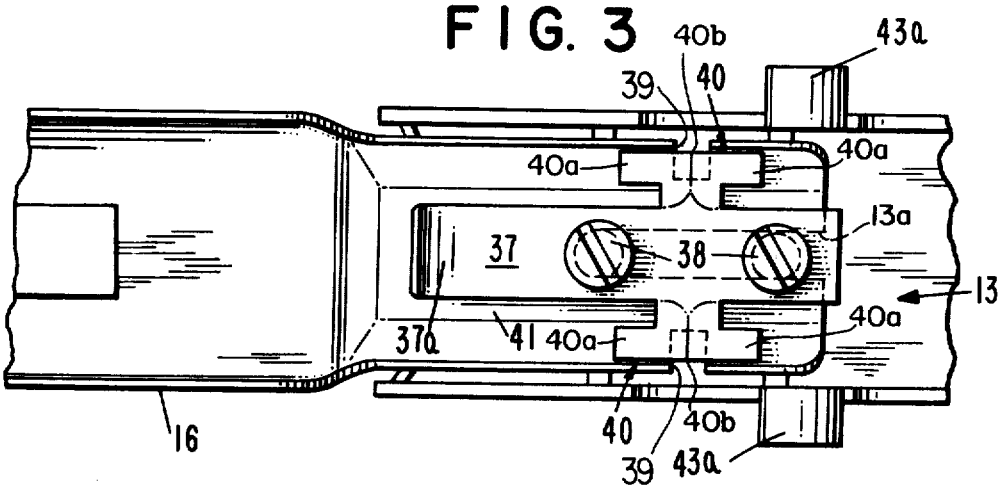
FIG. 3 is an enlarged bottom view of a preferred embodiment of a coupling arrangement for attaching a clip to the appliance of FIG. 1.

As is seen in the preferred embodiment of FIGS. 1 through 4, the first end portion 17 of the clip 16 includes a slot 32, which is defined by projecting arms 33. The arms 33 depend from a tapered portion 34 of the clip 16. As is seen in FIGS. 3 and 4, the slot 32 receives smooth shank portions 35 of screws 36, which project inwardly from a land portion **13*a* of the button 13. A leaf spring 37 is held loosely on the screws 36 by the heads 38 of the screws and is deflected by the slotted first end portion 17 of the clip 16 to hold the clip frictionally coupled to the button 13, when the clip is inserted between the spring and button. By having a pair of spaced screws 36, registered with the slot 32, lateral pivoting of the clip 16 about the slotted first end 17** is prevented.

In order to hold the clip 16 in place within the button 13, the first end portion 17 of the clip is provided with a pair of notches 39 which open laterally outward with respect to the clip. The nothces 39 are engaged by bowed detents 40 having oppositely sloping ramps **40*a* which converge to apexes 40*b*, projecting from opposite sides of the leaf spring 37, which resiliently seat within the notches to detachably couple the clip to the button 13, so that the clip may be slid in and out of engagement with the button. In addition, an area 41 of the clip 16 adjacent the slot 32, is flattened to enhance contact between the clip and spring 37, and the spring 37 has a bowed lip portion 37*a*, which guides the clip to ride over the spring, so as to seat between the spring and the land position 13*a*** of the button.

Figure 9:
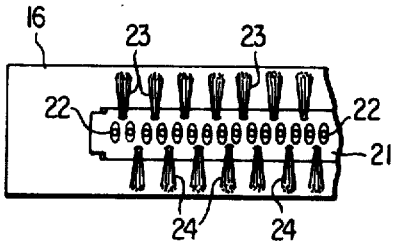
FIG. 9 is a top view of the comb-brush clip of FIG. 1, showing the relative spacing of bristle tufts and comb teeth.

As seen in FIG. 9, the tufts of bristles 23 and 24 on the base 21 of the clip 16 are aligned with the spaces between the teeth 22. More specifically, the tufts are aligned with alternate spaces, so that a tuft 24 is aligned with the first space, a tuft 23 is aligned with the second space, a tuft 24 is aligned with the third space, a tuft 23 is aligned with the fourth space and so forth. Accordingly, tufts 23 and 24, on opposite sides of the comb, are aligned with alternate spaces between the teeth 22. The tufts 23 and 24 serve to tension the strands of hair, so that hair may be readily wound around the tubular barrel 12 of the appliance 10.

Referring now to the retaining clip 14, which functions similarly to the clip disclosed in U.S. Pat. No. 3,835,292, the retaining clip has a slotted first end portion 17*a* which is similar to the slotted first end portion 17 of the comb-brush clip 16. Accordingly, a slot 32*a* in the end portion 17*a* of the hair retaining clip 14, receives shank portions 35 of the screws 36 therein, as shown in FIG. 2. The only substantive difference, between the end portions 17 and 17*a* of the clips 16 and 14, is that the clip 14 includes a bent portion 42, which raises the end 17*a* above the rest of the clip, so as to insure engagement between the clip and the tubular barrel 12. The height of the bent portion 42 is approximately equal to the thickness of the portion of the base 20 disposed between the comb-brush clip 16 and tubular barrel 12 (see FIG. 2).

The button 13 is mounted on the handle 11 by a sliding pivot 43. The sliding pivot 43 includes pins 43*a* on the button, which engage ramps 43*b* on the housing. In order to form a curl, the button 13 is pressed to pivot clip 14 out of engagement with barrel 12. Strands of hair are then inserted between the clip 14 and barrel 12, and the appliance 10 is manually rotated to curl the strands of hair therearound. After the curl is formed, the strands of hair can tend to bind the clip 14 to the barrel 12, so that the curl cannot be released easily by pivoting the clip away from the barrel. Consequently, the button 13 is pushed forward in a direction away from the handle 11, so that the pins 43*a* ride up the ramps 43*b*, and the clip 14 lifts slightly away from the tubular barrel 12. The curl of hair, formed around the barrel, can then be slid axially from the barrel with relative ease. The button 13 thereby provides a means for selectively moving attachments. Therefore, if necessary to pivot an attachment, the button provides means to do so.

The appliance 10 includes a fluid dispensing device 45, which is depressed into the tubular barrel 12, against the bias of a spring 46, so as to engage a wick 47 with an anvil 48, disposed within an annular ceramic heater 49. Liquid within a detachable reservoir 51, threadably secured in the button 45, is carried by the wick 47, so as to vaporize upon engaging the wick with the anvil 48. The resulting vapor migrates along channel 52 and escapes through apertures 53 (FIG. 1), which are disposed in a slot 54 (FIG. 1), formed in a metal hair treating mandrel or hair treating section 55 of the tubular barrel 12. The apertures 53 are preferably generally tangential to the outer surface of the mandrel 55. The mandrel or hair treating section 55 is in heat conductive relationship with the ceramic heater 49, so that it is heated thereby.

Figure 7:
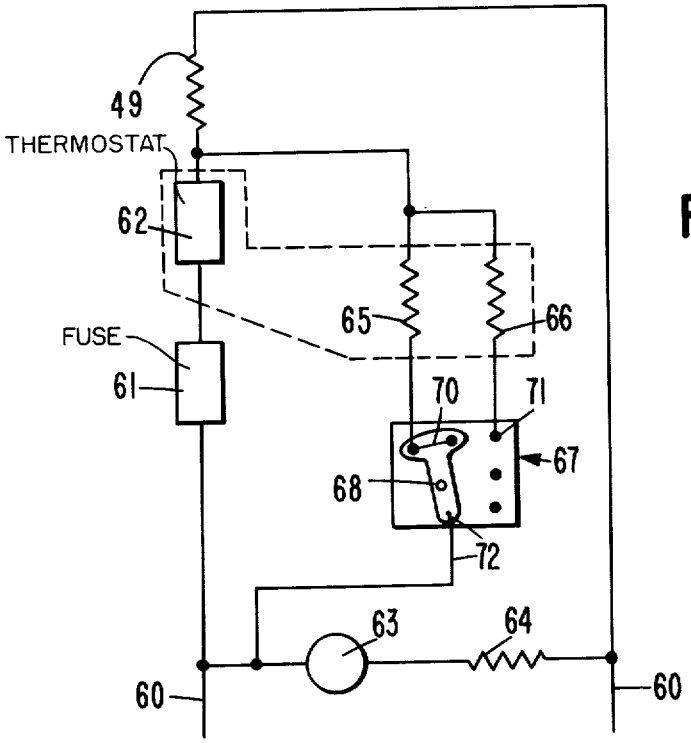
FIG. 7 is a schematic view of a heater control circuit for the thermal hair styling appliance.
Figure 8:
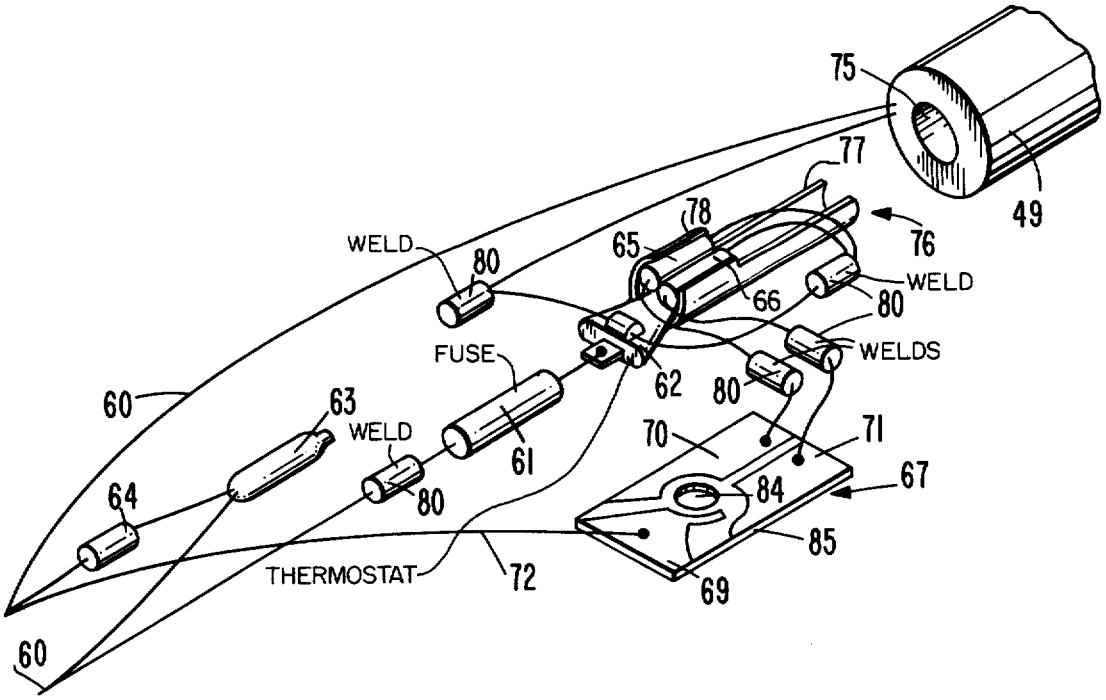
FIG. 8 is a perspective view showing the mechanical arrangement of the various circuit elements schematically shown in FIG. 7.

In order to selectively control the amount of heat available to treat the hair, the heater 49 is equipped with the control circuit of FIGS. 7 and 8. FIG. 7 schematically illustrates the circuit, while FIG. 8 illustrates the mechanical appearance of the various circuit components, before they are mechanically connected to the heater 49 within the appliance 10.

Referring now specifically to FIG. 7, the heater 49 is energized by current from a power line 60, which is connected to an external power source. A fuse 61 and thermostat 62 are in series with the heater. The fuse 61 will permanently trip to interrupt operation of the circuit, if the circuit overheats. The thermostat 62 interrupts current flow to the heater 49 at a predetermined temperature level of the heater, and thereby controls operation of the heater. The appliance 10 is turned on by plugging into an external power source. A neon light 63, with a suitable resistor 64 is disposed in parallel with the power line 60 and lights to indicate when current is flowing through the power line. The appliance is turned off by unplugging from the power source.

In order to provide a plurality of temperature levels, first and second resistors 65 and 66 are disposed adjacent to the thermostat 62, and are connected by a switch 67 to the power line 60. The resistor 65 has a relatively high resistance and generates relatively little heat, while the resistor 66 has a relatively low resistance and generates relatively high heat. As described hereinafter, there are four temperature levels selectable through controlling the switch 67.

The thermostat 62 responds to the heat generated by the resistors 65 and 66, as well as to the heat generated by heater 49. If the resistors 65 and 66, either in combination or alone, are generating a sufficiently large amount of heat, the thermostat 62 will trip and cut off current to the heater 49 before the heater alone reaches a temperature level sufficient to trip the thermostat. As explained hereinafter, by selectively energizing the resistors 65 and 66, one may control the temperature of the heater 49.

Specifically, the switch 67 includes a wiper arm 68 and contacts 70 and 71, which are connected to the resistors 65 and 66, respectively. The wiper arm 68 makes continuous contact with a contact 69, which is connected to a line 72 from the power line 60. The lowest heat level occurs when the wiper arm 68 is in contact with both contacts 70 and 69, so that both the resistors 65 and 66 are energized. When both the resistors 65 and 66 are energized, the thermostat 62 reacts to the sum of the heat generated by the resistors, plus the heat from the heater 49. Consequently, the thermostat 62 trips well before the main heater 49 reaches full temperature. This is the low temperature setting.

The next highest temperature setting occurs when the wiper arm 68 connects only contact 71 with line 72 leaving contact 70 open. In this case, the low-wattage resistor 65 is not energized while the high-wattage resistor 66 is energized. Accordingly, the thermostat 62 now responds only to the combination of heat from the resistor 66 and heater 49. Since there is now less heat from the resistors (only resistor 66 is energized), the heater 49 will generate a greater proportion of the total heat applied to the thermostat 62 and thus the heater will reach a higher temperature before the thermostat is tripped.

The next highest temperature setting occurs when the wiper 68 bridges line 72 and contact 70. Keeping in mind that the resistance of resistor 65 is more than that of the resistor 66, the heater 49 will now make up a larger proportion of the heat supply to the thermostat 62. Consequently, the heater 49 will reach an even higher temperature before tripping the thermostat 62.

The highest temperature setting occurs when the wiper arm 68 connects neither the contact 70 nor the contact 71 to line 72 via contact 69, so that the resistors 65 and 66 are both open. In this case, only the heater 49 is energized and the thermostat 62 will respond directly, and only to the heat from the heater 49. Since the heater 49 now supplies all of the heat to the thermostat 62, the thermostat will not trip until the heater alone reaches a temperature level high enough to trip the thermostat. This, of course, is the highest temperature level of the device.

In the afore-described way, the heater 49 can be positively and accurately controlled by selectively tripping the thermostat 62 with the resistors 65 and 66, which are in effect auxiliary heaters from the thermostat.

Referring now to FIG. 8, where the mechanical assembly of the circuit of FIG. 7 is shown, the heater 49 is preferably an annular ceramic heater having a circular bore 75 extending therein. Received in the bore 75 is a mounting clip, designated generally by the numeral 76. The mounting clip 76 has a circular insertion portion 77, which slides into the bore 75 and a retaining portion 78, which is not received within the bore 75 (see FIG. 2). Both the insertion portion 77 and retaining portion 78 are formed by rolling or bending a suitably shaped piece of aluminum. The thermostat 62 is held in engagement with the resistors 65 and 66 by the retaining portion 78, while the insertion portion 77 holds the thermostat and resistors in juxtaposition with the heater 49. Generally, standard items are used to construct the circuit, and they are connected together by welds, identified by the numerals 80.

The thermostat 62 is designed to allow sufficient amount of heat to be made available for treating the hair, so that at the highest setting of the dial 82 will allow the barrel to be heated to curl the hair, and the lowest setting allows the generation of a sufficient amount of heat to produce steam. Depending on the particular materials used and the overall design, different values for resistors 65 and 66 will apply. For example, ½ watt resistors may be utilized to conserve cost and space. In practice, the resistor 65 dissipates 2.6 watts, while the resistor 66 dissipates 4.8 watts. Thermal dissipation of the wattage is prevented by close thermal coupling between the thermostat 62 and the resistors 65 and 66 effected by the retaining portion 78. The disclosed arrangement is further advantageous in that once the resistors 65 and 66 reach the threshold temperature of the thermostat 62 and cause the thermostat contacts to open, power is shut off not only to the heater 49, but also to the resistors, as the thermostat cycles. When the system cools, the thermostat contacts again close, energizing the heater 49 and the resistors 65 and/or 66, depending on the position of the wiper arm 68.

As is seen in FIG. 2, the switch 67 is operated by a dial 82 disposed on the outside of the handle 11, which is rigidly connected to the wiper arm 68 by a shaft 83 projecting from the dial. The shaft 83 is journaled in a hole 84 bored through a supporting substrate 85 of insulating material, upon which the contacts 70 and 71 are mounted, and to which the line 72 is attached via the contact area 69 (see FIG. 8). The dial 82 is retained on the substrate 85 by a spring clip 86, which engages the shaft 83 on the opposite side of the substrate.

Since the appliance 10 is handheld the power lines 60 are preferably connected to house current by a swivelling electrical connector 95, which allows the appliance to be manipulated without tangling the cord.

ADDITIONAL EMBODIMENTS FOR THE COUPLING MEANS

Figure 5:
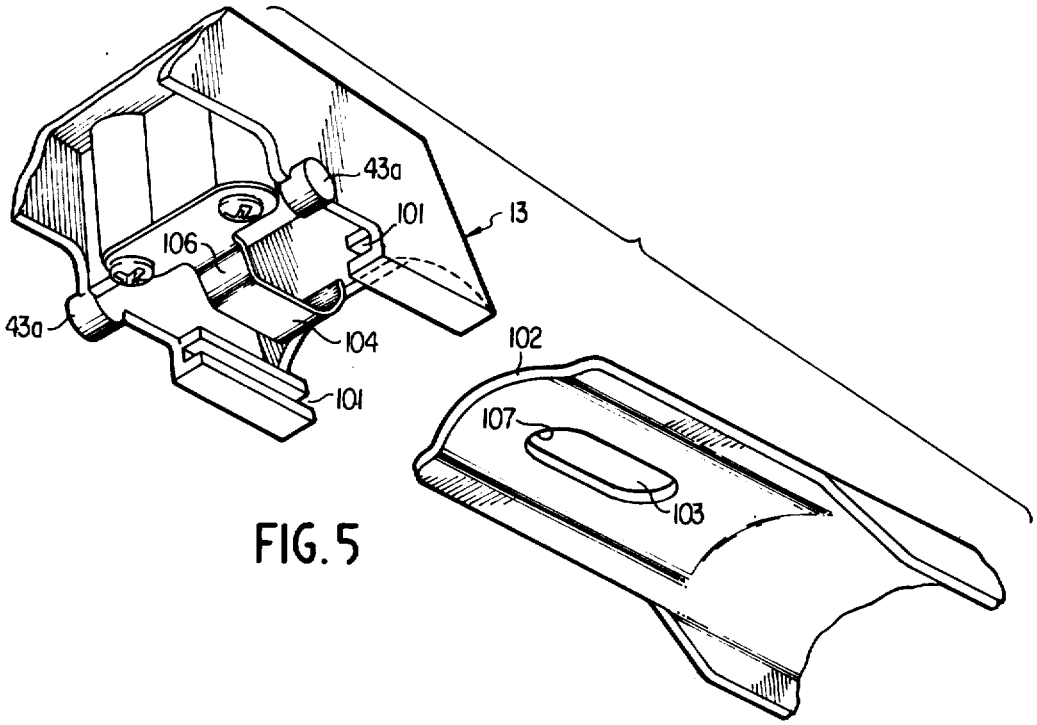
FIG. 5 is an exploded perspective view of a second embodiment of a coupling arrangement.
Figure 6:
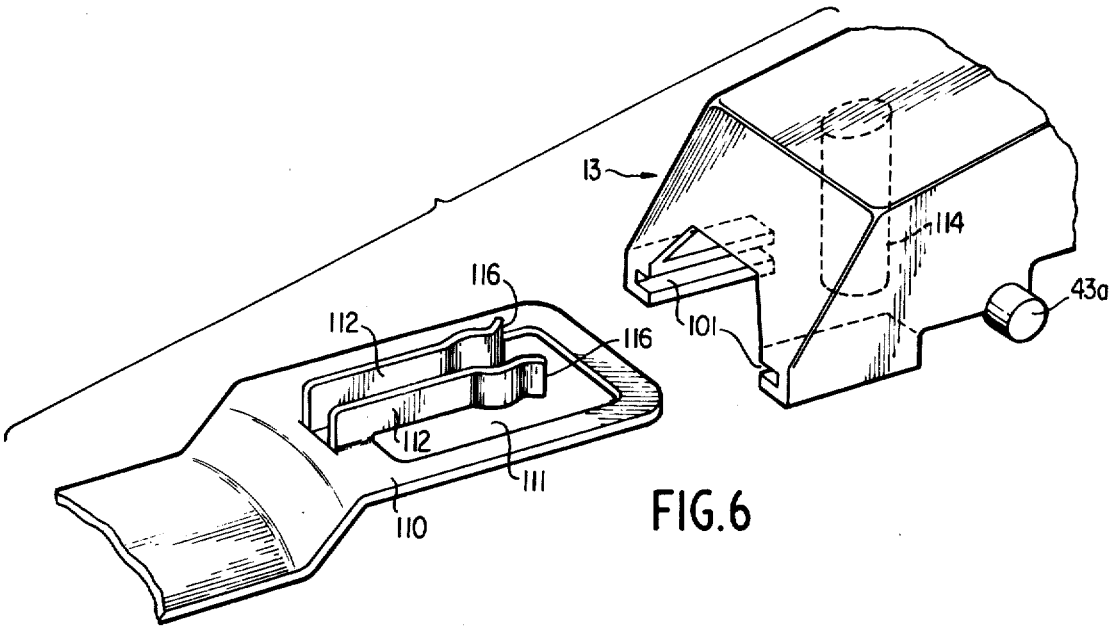
FIG. 6 is an exploded perspective view of a third embodiment of a coupling arrangement.

While the coupling structure of FIGS. 3 and 4 is preferred to join clips, such as clips 14 and 16, to the button 13 alternative embodiments, such as those of FIGS. 5 and 6, are within the scope of this invention.

In the embodiment of FIG. 5, the button 13 includes a pair of opposed slots 101 which receive the end 102 of a clip, such as one of the clips 14 and 16. The end has a slot 103 therein, which receives a detent 104, which may be part of a spring 106, which may be a U-shaped leaf spring mounted within the button 13 to both bias and support the detent. The detent 104 may have a slightly beveled rear surface, so that when the end 102 of the clip is inserted between the slots 101, the end will be held within the slots by the detent, which seats in the slot 103. However, when the clip is pulled, the rear surface 107 of the slot 103 will cam the detent 104 out of the slot 103 against the bias of the spring 106 allowing the clip to be released.

In the embodiment of FIG. 6, the ends 110 of the clips are modified by forming a cutout 111 therein, and positioning a pair of spring arms 112 adjacent the cutout. The spring arms 112 define a widened retaining area 113, which grip a fixed detent 114 projecting from the button 13, so as to detachably hold the end 110 in the slots 101 of the button. The spring arms 112 have flared portions 116, which cam the spring arms apart when engaged by the detent 114, allowing clips to snap in and out of engagement with the projection 114.

The foregoing examples and embodiments provide a new and improved thermal hair styling appliance, which has great flexibility and versatility. However, the foregoing embodiments are merely descriptive of the invention, which is to be limited only by the following appended claims. While two specific attachments are illustrated, the attachments may assume any suitable configuration consistent with the following appended claims.

What is claimed is:

1. A hair treating device comprising:

a tubular barrel extending along an axis, said tubular barrel having first and second ends and defining a heating chamber therein;

heating means disposed in said tubular barrel;

vapor generating means disposed in said tubular barrel and energized by said heating means;

a hair treating section of said tubular barrel along which heat and vapor are transmitted to the hair;

a housing attached to said first end of the tubular barrel, said housing forming a handle;

a readily detachable hair styling attachment cooperating with said tubular barrel in styling the hair, said attachment including a longitudinally extending open slot in one end thereof and a pair of notches disposed adjacent said one end of the attachment;

an operating button;

means for mounting said operating button in said handle and adjacent to the first end of said tubular barrel, said mounting means mounting said operating button to both slide and pivot relative to said handle and said tubular barrel; and coupling means included in said operating button for detachably securing said attachment thereto, wherein the coupling means includes:

a land within said button;

at least one projecting means extending from the land toward the tubular barrel, said projecting means including an enlarged head portion spaced from said land a distance greater than the thickness of the attachment; and a leaf spring retained on said projecting means by said head portion, wherein said leaf spring includes a pair of detents having oppositely sloping ramps which converge to an apex, and wherein said attachment is held between the leaf spring and the land with the projecting means received in the slot of the attachment and the apexes of the detents received in the notches of the attachment in order to detachably couple the attachment to the button, so that the attachment may be removed from the button by pulling the attachment away from the button and coupled to the button by pushing the attachment toward the button.

2. The hair treating device of claim 1, wherein the projecting means including an enlarged head portion is a pair of headed screws arranged in tandem with respect to the axis of the tubular barrel.

3. The hair treating device of claim 2, wherein the leaf spring includes a lip projecting at an angle toward the barrel to guide the attachment between the leaf spring and land when the attachment is inserted into the button.

4. The hair treating device of claim 3, wherein the notches in the attachment open laterally outward and, wherein the detents on the leaf spring project laterally outward and are disposed between the screws which form the projecting means.

5. The hair treating device of claim 4, wherein the heating means is electrical and includes circuitry which comprises:

a main heating element for producing heat to both treat hair and generate vapor;

a thermostat in thermal conductive relation with said heater for controlling energization of said heater;

auxiliary resistive heaters in thermal conductive contact with said thermostat; and means for selectively energizing said auxiliary heaters for causing said thermostat to react to the auxiliary heaters, as well as said main heater, so as to control the main heater by selectively activating the auxiliary heaters.

6. The hair treating device of claim 5, wherein there is a pair of auxiliary heaters disposed in contact with the thermostat, and wherein switch means are included so that the heaters may selectively be both energized, separately energized or not energized, in order to control the amount of heat generated by the main heater.

7. The hair treating device of claim 6, wherein the pair of auxiliary heaters and thermostat are held in contact by clip means which is, in turn, inserted into a cavity within the main heater.

8. The hair treating device of claim 5, wherein a fuse is connected in series with the thermostat, and wherein a neon lamp is connected in parallel across the circuit for indicating that the circuit is energized.

9. The hair treating device of claim 1, wherein the attachment is a clip which includes:

an elongated portion which extends over said hair treating section;

a base fixed to said elongated portion;

a comb formed by a row of relatively rigid teeth projecting from said base along each side of said comb, wherein the individual tufts in the first row are aligned with spaces between every other tooth, wherein the individual tufts of the second row are aligned with spaces between the teeth not having an individual tuft from the first row of tufts aligned therewith and wherein said first and second row of individual tufts cooperate with said row of teeth to tension the hair just prior to winding the hair around the apparatus to form a curl.

10. The hair treating device of claim 9, wherein the elongated portion includes an annular portion which is slid over the tubular barrel to prevent the clip from pivoting with respect to the tubular barrel.

11. The hair treating device of claim 1, wherein the attachment is a clip which extends along and over a portion of the hair treating section and wherein the clip is pivoted and slid by operating the operating button in order to clamp and unclamp hair between the clip and the hair treating section.

* * * * *